United States Patent [19]

Gurtner et al.

[11] 4,318,635

[45] Mar. 9, 1982

[54] CULVERT STRUCTURE HAVING CORRUGATED RIBBING SUPPORT

[75] Inventors: Mark A. Gurtner, Pulaski; Charles D. Gorman, Bethlehem, both of Pa.

[73] Assignee: Bethlehem Steel Corporation, Bethlehem, Pa.

[21] Appl. No.: 166,420

[22] Filed: Jul. 7, 1980

[51] Int. Cl.[3] ..... E01F 5/00

[52] U.S. Cl. ..... 405/126; 405/288

[58] Field of Search ..... 405/124, 125, 126, 150, 405/151, 288

[56] References Cited

U.S. PATENT DOCUMENTS

| | | | |
|---|---|---|---|
| 832,017 | 9/1906 | Hummel | 405/126 |
| 1,999,500 | 4/1935 | Carswell et al. | 405/124 |
| 3,508,406 | 4/1970 | Fisher | 405/124 |
| 4,141,666 | 2/1979 | DeGraff | 405/126 |
| 4,211,504 | 7/1980 | Sivachenko | 405/124 X |

FOREIGN PATENT DOCUMENTS

| | | | |
|---|---|---|---|
| 862402 | 2/1971 | Canada | 405/126 |

*Primary Examiner*—David H. Corbin

*Attorney, Agent, or Firm*—J. J. O'Keefe; W. B. Noll

[57] ABSTRACT

A low-profile culvert structure comprising in combination, a plurality of arch-shaped corrugated structural metallic sheets secured to each other in such a manner as to form an elongated shell having typically a low rise to span ratio, and a plurality of transverse reinforcing ribs, each in the form of a corrugated metallic sheet. The transverse reinforcing ribs are secured to said shell at intervals along the length thereof, preferably to both the interior and exterior of the elongated shell.

11 Claims, 14 Drawing Figures

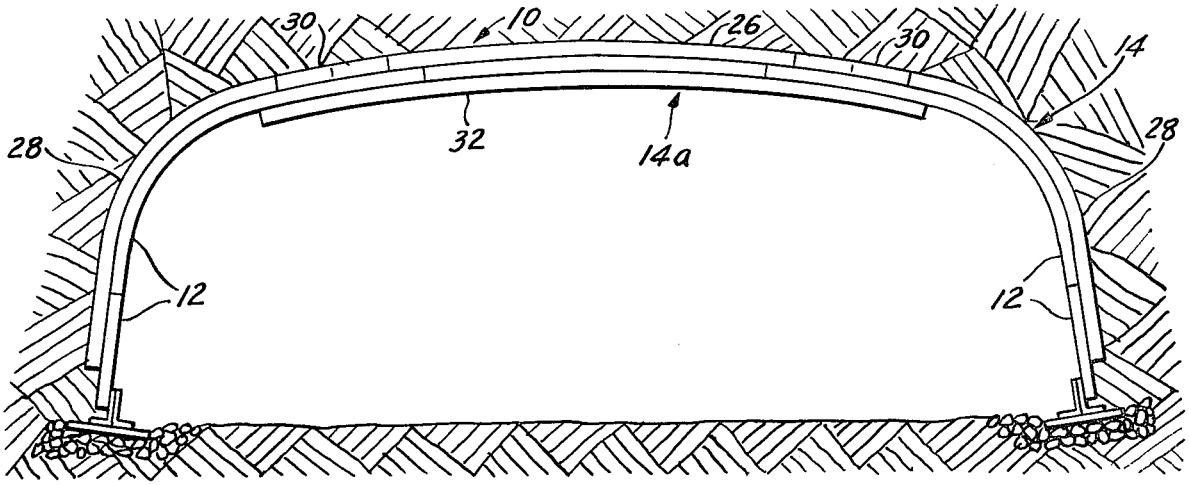
FIG. 1
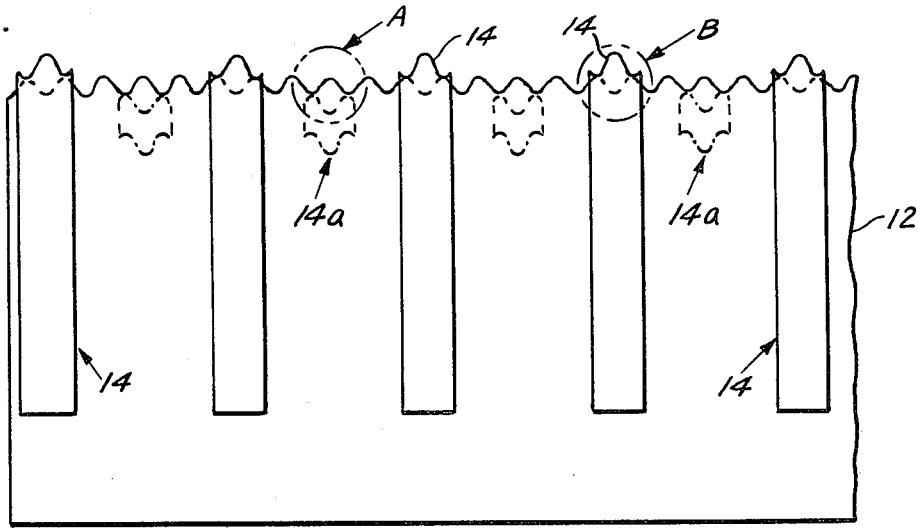
FIG. 2
FIG. 3
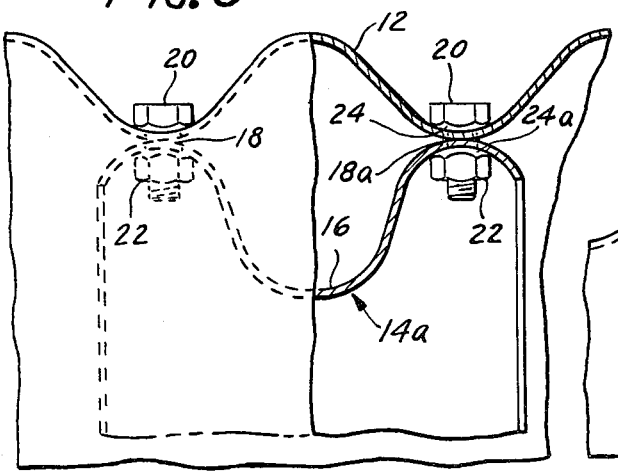
FIG. 4
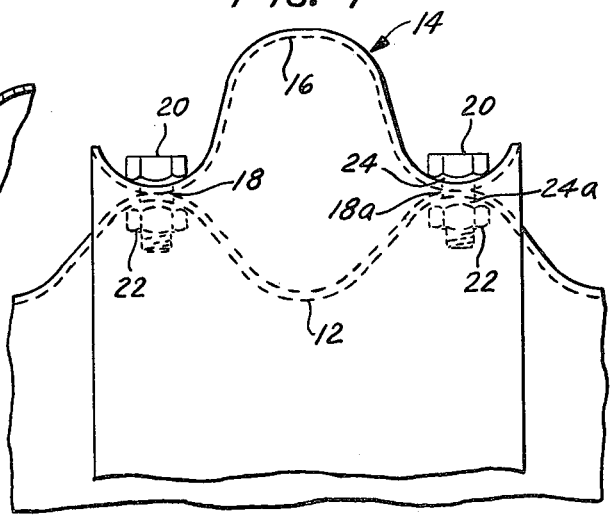

CULVERT STRUCTURE HAVING CORRUGATED RIBBING SUPPORT

BACKGROUND OF THE INVENTION

The present invention is directed to a low-profile culvert structure composed essentially of interconnecting corrugated metallic sheets to form the shell, and corrugated metallic sheets secured to said shell for support.

One structural limitation of low profile culverts, i.e. low rise to span ratio, is the susceptibility to failure by deflection or flattening during installation, and more particularly during use. A recent attempt to develop a low-profile, corrugated culvert structure, resistant to a susceptibility to flatten, is described in U.S. Pat. No. 4,141,666 to DeGraff. The culvert described therein is characterized by a shell formed of interconnecting arch-shaped corrugated metal sheets. Support for the shell is provided by cross-ribs, in the form of aluminum extrusions, and by stringers, i.e. box-shaped aluminum extrusions, extending substantially the entire length of the culvert structure along the interior of the shell. The latter supports are a critical feature of the DeGraff structure. The stringers, by extending substantially the entire length of the structure, (1) act as stiffening members and strengthen the culvert against collapse, (2) act to integrate the various sections of the shell into a single unitary structure, and thereby distribute overhead loads throughout the structure, and (3) replace the support typically provided in prior art culvert structure by flooring.

The low-profile culvert structure of the present invention, while presenting a geometry profile similar to that of DeGraff, is readily distinguishable therefrom by the absence of such stringer supports extending substantially the entire length of the culvert structure. Further distinguishing features will be apparent by the description which follows.

BRIEF DESCRIPTION OF DRAWINGS

FIG. 1 is a sectional view of an assembled and installed low-profile culvert structure according to this invention.

FIG. 2 is a partial side elevational view of a preferred low-profile culvert structure according to this invention.

FIG. 3 is an enlarged, partially sectioned view of the culvert portion identified as A in FIG. 2.

FIG. 4 is an enlarged, partially sectioned view of the culvert portion identified as B in FIG. 2.

Figure 5A:
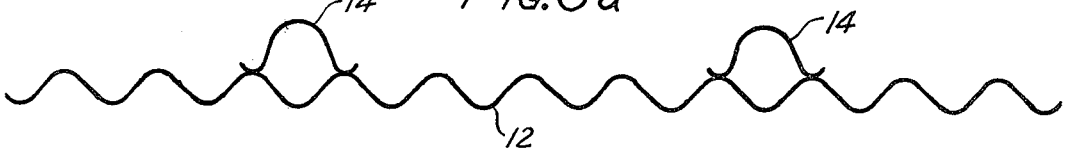
FIGS. 5*a* through 5*g* are simplified, sectional views of seven different culvert support embodiments for the culvert structure according to this invention.

FIG. *7a* is a partial end view of a preferred footer arrangement for an assembled and installed low-profile culvert structure according to this invention.

FIG. *7b* is a partial end view, similar to FIG. *7a*, of a second embodiment for the footer arrangement.

DETAILED DESCRIPTION OF DRAWINGS

Referring to the several FIGURES, the low-profile culvert structure 10 of the present invention comprises in combination, a plurality of corrugated structural metallic sheets 12 secured to each other to form a curved arch, and a plurality of transverse reinforcing ribs 14, 14*a* for support.

A typical arch section may be assembled by joining, for example, six formed, corrugated structural metallic sheets 12, preferably galvanized steel, end to end. The length of the culvert structure will vary depending on its application or end use. The ultimate length is a function of the combination of various standard length sections secured to one another by overlapping along the edges thereof. These integrally secured arch sections form the shell for the basic culvert structure of this invention. However, for such a structure to function as a load-bearing structure, it may require additional strength. Such additional strength, in the form of transverse reinforcing ribs 14, 14*a* including the shape and manner of cooperation with said shell, is a critical feature of the present invention.

Strength for the arch-shaped, corrugated shell described above is provided by a plurality of transverse reinforcing ribs 14, 14*a*, each in the form of a corrugated metallic sheet. For convenience in the discussion which follows, such transverse ribs will be described with reference to a typical dimension, namely, 6″×3″. The first value is the nominal width conforming to the center to center of corrugations of metallic sheet 12; whereas, the latter value represents the crest height. For such a transverse rib to be effective in the culvert structure of the present invention, the repeat pattern of the corrugated shell must be equal to or a simple multiple of the repeat pattern of such rib. However, it has been determined that the crest height of the reinforcing rib should be at least as much or greater than the crest height of the shell corrugation to provide adequate strength.

It will be understood that low-profile culvert structures of the type described herein are designed to be flexible, i.e. non-rigid. Obviously, the flexing must be less than the elastic limits of the metallic sheet material. Thus, the flexibility of the structure is a design consideration which is present to transfer loads to the surrounding soil. For these low-profile culvert structures the surrounding soil carries the bulk of the overhead weight. As a consequence of these design considerations, the reinforcing ribs 14, 14*a* must be such as to provide strength to the structure, while at the same time permitting flexibility. A crest height which is too great, for example six (6) inches or more, may cause the structure to be too rigid. Thus, by way of example, a 6″×2″ corrugated shell may use reinforcing ribs designated by the dimensions, 6″×3″. Characteristics of each reinforcing rib 14, 14*a* are its relative length to width (FIG. 2), and a cross-section revealing a simple crest 16 with two adjacent valleys 18, 18*a*, FIGS. 3 and 4. The latter FIGURES illustrate the manner by which such reinforcing ribs are secured to the corrugated shell. Specifically, to minimize stress points, fasteners, such as nut 20 and bolt 22 combinations, are provided with a rounded portion 24, 24*a* adjacent the corrugated metallic sheet, as shown in FIGS. 3 and 4.

The reinforcing ribs 14, 14*a*, as noted previously, are disposed along the length of the corrugated shell and secured preferably to both the exterior and interior thereof, FIGS. 1 to 3. However, it has been determined that at least some of the exterior reinforcing ribs must be of a length to nearly encircle the shell periphery. That is, as best shown in FIG. 1, such exterior reinforcing rib 14 comprises a crown portion 26 joined by splicing to two haunch portions 18. The splice 30 may be a short corrugated metallic sheet overlapping the ends of adjoining crown and haunch portions 26 and 28, respectively.

The interior reinforcing ribs 14 are preferably comprised of only a crown portion 32. However, it is contemplated by the present invention that the interior reinforcing ribs 14*a* may be extended in a manner similar to that illustrated in FIG. 1 for the exterior reinforcing ribs 14.

Figure 5B:
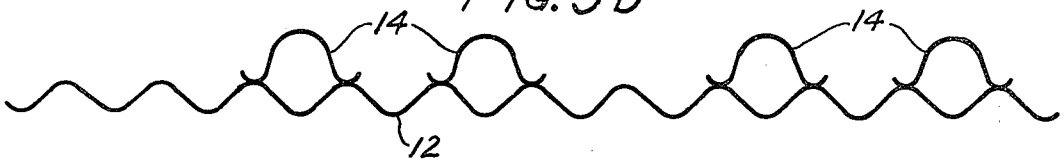
Figure 5C:
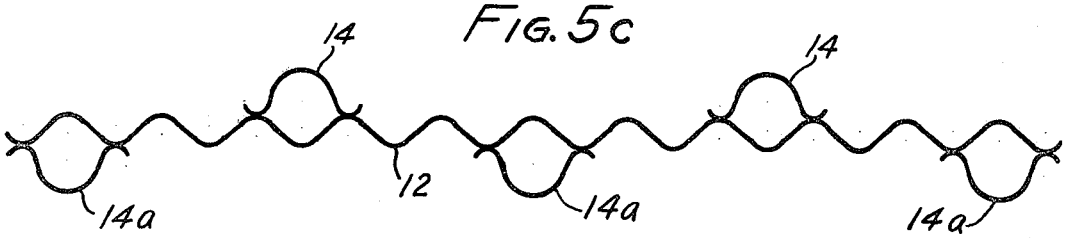
Figure 5D:
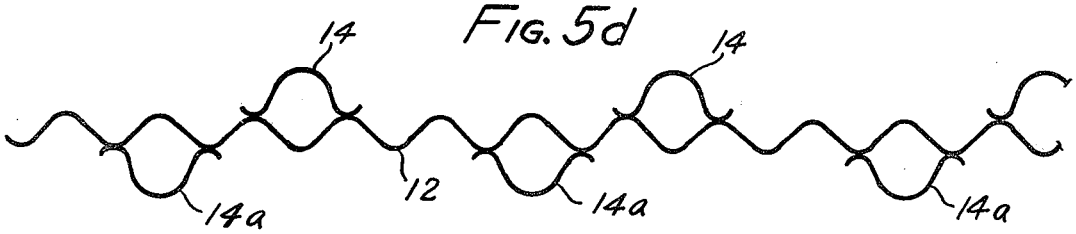
Figure 5E:
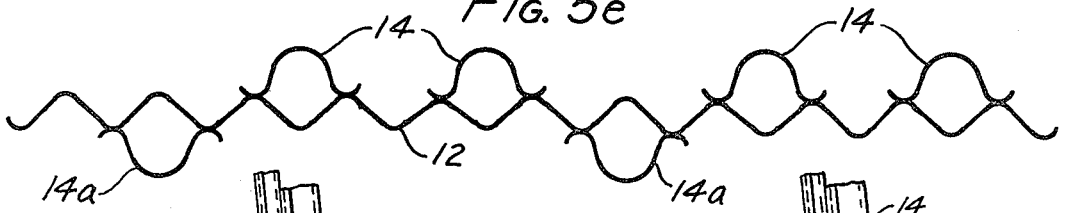
Figure 6:
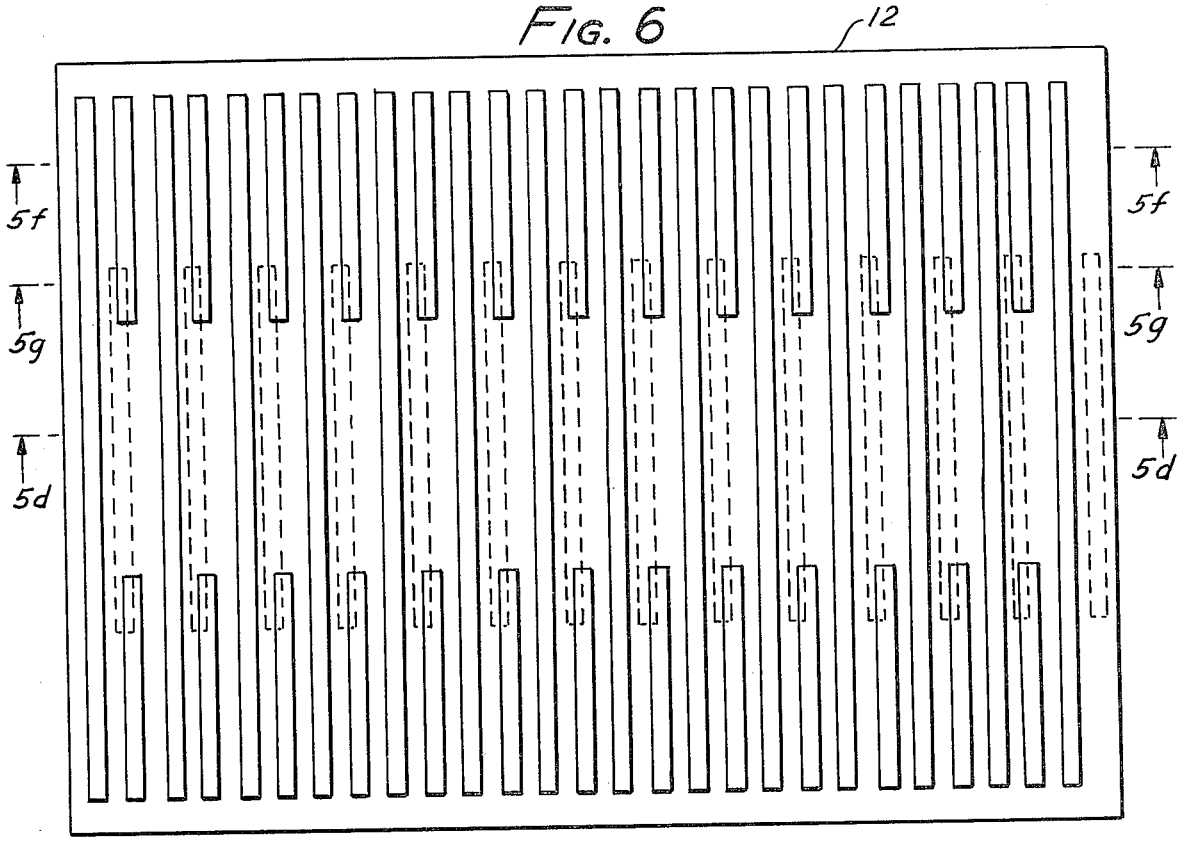
FIG. 6 is a developed plan view of a preferred embodiment for the low-profile culvert structure according to this invention.
Figure 5F:
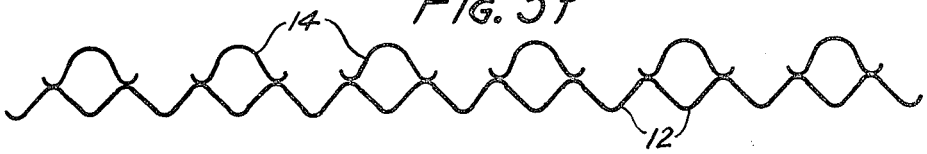
Figure 5G:
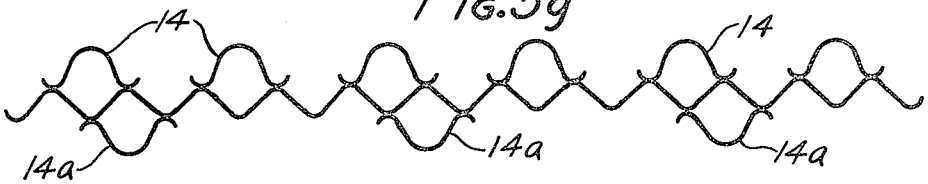

The precise number and arrangement of reinforcing ribs for the culvert structure of this invention is a function of the existing forces at the site of the culvert installation. An analysis of such forces is made; then, using a factor of safety, determine the strength necessary to meet such forces. Thus, for smaller structures where such forces may be low, a shell section profile may have the appearance as shown in FIGS. 5*a* through 5*b*, i.e. no internal ribbing. For larger span, low-profile culvert structures, internal ribbing is essential. These larger culvert structures will thus have a shell section profile, for example, such as illustrated in FIGS. 5*d* and 5*e*. Finally, an analysis of the existing forces at a site installation may reveal that a combination of shell section profile may be most suitable. FIG. 6 is a developed plan view of a preferred embodiment for a low-profile culvert structure utilizing three ribbing arrangements, note FIGS. 5*d*, 5*f*, and 5*g*.

Figure 7A:
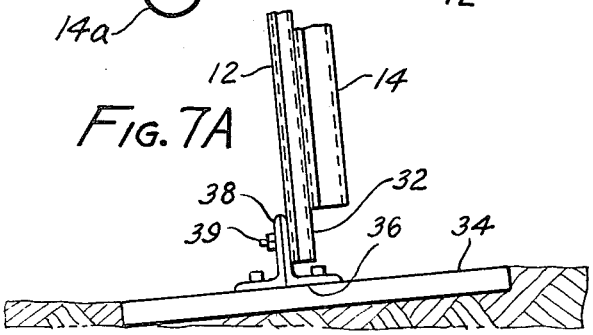
Figure 7B:
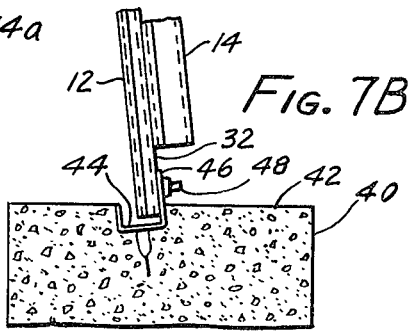

One major advantage of the low-profile culvert structure of this invention is the structure's ease of erection. If convenient, the structure may be erected or fabricated adjacent the installation site and moved into position as desired. The only necessary on-site work is leveling the ground to receive such structure and preparing the footers for anchoring the shell ends 32. Such footers as illustrated in FIGS. 7*a* and 7*b* are suitable for the culvert structure of the present invention. The footer of FIG. 7*a* includes a footer plate 34 having an L or T shaped member 36 anchored thereto. The upstanding leg 38 of member 36 is provided with a plurality of holes through which fasteners 39, 40 are passed to secure the shell ends 32 to the upstanding leg 38. The footer arrangement of FIG. 7*a* is simple, yet effective, for the culvert structure of this invention. The footer plate 34 is angled such that the forces transmitted by the shell 12 act normal to plate 34. As a consequence, it is unnecessary to anchor the footer plate 34.

A second and more conventional type of footer arrangement is illustrated in FIG. 7*b*. For such an arrangement a concrete foundation 40 is provided. Along the upper surface 42 of the foundation a channel member 44 is positioned to receive shell ends 32. To secure the shell end to the channel member 44, one leg 46 of said channel member extends above surface 42, said leg 46 providing the means to anchor the shell ends 32. Again, holes along the length of leg 46 are provided to receive fastening members 48 which engage the shell ends 32.

We claim:

1. In a flexible culvert structure formed of a plurality of arch-shaped corrugated structural sheets secured to each other in a manner to form a low profile box culvert, where said sheets are characterized by a valley-to-valley dimension "X" and a crest height "Y", the improvement comprising in combination therewith, the provision of a plurality of spaced apart transverse reinforcing ribs in the form of corrugated metallic sheets consisting of a simple crest with two adjacent valleys secured to said arch-shaped corrugated structural metallic sheets at intervals along the length of said culvert structure, where individual transverse reinforcing ribs are characterized by a valley-to-valley dimension "X" and a crest height greater than "Y", and are secured to either the interior or exterior of said culvert structure.

2. The culvert structure claimed in claim 1 wherein there are a plurality of exterior transverse reinforcing ribs and a plurality of interior transverse reinforcing ribs.

3. The culvert structure claimed in any one of claims 1 or 2 wherein certain of said exterior transverse reinforcing ribs are characterized by two haunch portions joined together by a crown portion.

4. The culvert structure claimed in claim 3 wherein each said transverse reinforcing rib is joined to adjacent corrugations of said box culvert forming corrugated structural metallic sheets.

5. The culvert structure claimed in any one of claims 1 or 2 wherein said structure is characterized by the absence of longitudinal support members.

6. The culvert structure claimed in any one of the claims 1 or 2 wherein the bottom end edges of said arch-shaped corrugated structural metallic sheets are secured to a footer plate, where said footer plate is arranged to act normal to said bottom end edges.

7. The culvert structure claimed in any one of claims 1 or 2 wherein each interior transverse reinforcing rib is characterized by only a crown portion.

8. The culvert structure claimed in claim 7 wherein each said transverse reinforcing rib is joined to adjacent corrugations of said box culvert forming corrugated structural metallic sheets.

9. The culvert structure claimed in claim 8 wherein said structure is characterized by the absence of longitudinal support members.

10. The culvert structure claimed in claim 9 wherein the bottom end edges of said arch-shaped corrugated structural metallic sheets are secured to a footer plate, where said footer plate is arranged to act normal to said bottom end edges.

11. The culvert structure claimed in claims 1 or 2 wherein the bottom end edges of said arch-shaped corrugated structural metallic sheets are secured to a footer, said footer comprising a foundation having means projecting therefrom for securing said sheets.

* * * * *

UNITED STATES PATENT AND TRADEMARK OFFICE

CERTIFICATE OF CORRECTION

PATENT NO. : 4,318,635

DATED : March 9, 1982

INVENTOR(S) : Mark A. Gurtner and Charles D. Gorman

It is certified that error appears in the above—identified patent and that said Letters Patent is hereby corrected as shown below:

On the title page, Item [73]
Change the Assignee from "Bethlehem Steel Corporation, Bethlehem, Pa." to --Lane Metal Products Co., Inc.

Signed and Sealed this

Second Day of November 1982

[SEAL]

*Attest:*

GERALD J. MOSSINGHOFF

*Attesting Officer*

*Commissioner of Patents and Trademarks*